US005497394A

United States Patent [19]

Jhawar et al.

[11] Patent Number: 5,497,394

[45] Date of Patent: Mar. 5, 1996

[54] ELECTRIC HEATER ELEMENT SUPPORT

[75] Inventors: Suresh C. Jhawar, Anaheim Hills; John K. Grier, Walnut; Brian K. Grier, Chino Hills, all of Calif.

[73] Assignee: Grier-Jhawar-Mercer, Inc., Walnut, Calif.

[21] Appl. No.: 308,758

[22] Filed: Sep. 19, 1994

[51] Int. Cl.[6] ..... H05B 3/66

[52] U.S. Cl. ..... 373/130; 373/128; 219/520; 219/532

[58] Field of Search ..... 373/109–112, 117, 373/130, 131, 127–128; 219/532, 542, 390, 400, 520

[56] References Cited

U.S. PATENT DOCUMENTS

| | | | |
|---|---|---|---|
| 3,737,553 | 6/1973 | Kreider et al. | 373/112 |
| 3,798,417 | 3/1974 | Bittner | 219/532 |
| 3,812,276 | 5/1974 | Cyrway, Jr. et al. | 373/112 |
| 3,943,333 | 3/1976 | Kokjohn et al. | 219/532 |
| 3,963,859 | 6/1976 | Petersen et al. | 174/148 |
| 3,967,094 | 6/1976 | Petersen et al. | 219/532 |
| 4,056,678 | 11/1977 | Beall, III et al. | 373/112 |
| 4,289,955 | 9/1981 | Seeley | 219/532 |
| 4,771,166 | 9/1988 | McGuire et al. | 219/532 |
| 4,994,654 | 2/1991 | Louis | 219/532 |

*Primary Examiner*—Tu Hoang
*Attorney, Agent, or Firm*—Christie, Parker & Hale

[57] ABSTRACT

A vacuum furnace has a heating chamber heated by metal strip electric heater elements. The elements have insulated mechanical support between their ends to hold them in position in the furnace. Support is provided by a ceramic post having an internal thread in an outer end threaded onto a rod secured to a portion of the furnace. A transverse member at an inner end of the post includes a straight surface normal to the length of the post for engaging the heater element. The heater element is compliantly connected to the straight surface. One embodiment of heater element support is in the form of a T-shaped ceramic post having an internal thread in the leg of the T and a ceramic crossbar having a straight surface normal to the length of the post for receiving the heater element. Another embodiment has a ceramic post having an internal thread in the outer end of the post and a metallic crossbar having a straight surface normal to the length of the post for receiving a heater element.

36 Claims, 5 Drawing Sheets

ELECTRIC HEATER ELEMENT SUPPORT

BACKGROUND OF THE INVENTION

This invention relates to mounting of electric strip heating elements in high temperature vacuum or protective atmosphere furnaces.

Electric heating elements in high temperature vacuum furnaces are often made of strips of sheet molybdenum or the like. Electrical contact may be made to the ends of a long metal strip which wraps around the hearth of the furnace. Such a long heating element requires mechanical support intermittently along its length to hold it in proper position in the furnace and for preventing shorting to other parts of the furnace or the load being heated in the furnace.

Various techniques for providing insulated mechanical support for such a heater element have been employed, but few are completely satisfactory. Less than satisfactory heating element supports are described and illustrated in U.S. Pat. Nos. 3,737,553 by Kreider, 3,812,276 by Cyrway and 4,056,678 by Beall, for example.

Some heater supports have relied on an insulated post, or the like, extending through a hole in the strip heater. Although good mechanical support can be provided with such an arrangement, the hole is quite undesirable. The hole necessarily results in the heater having a narrower effective width at the location of the hole. Since there is less metal cross-section to carry the heating current, there is excess heating around the hole. This excess heating can be severe enough to burn out a heater under some circumstances and, if nothing else, it shortens the heater lifetime in that region. Heater elements most commonly fail at the end electrical contacts or in proximity to such holes.

Another type of heater support that does not require holes through the heater element is in a general form of a T. A sheet metal "post" forms the leg of the T, and the heater element lies on top of the top crossbar of the T. The heater element is secured to the crossbar by a rod lying on top of the heater element with twisted wires securing the bar to the crossbar of the T. Ceramic sleeves insulate the crossbar from the leg of the T to provide a compliant connection. Supports shown in the Kreider and Cyrway patents are of this general type.

Such heater supports have been plagued with deformation problems. There is insufficient rigidity in the T-shaped mounting to support the heater element as it tries to move under the forces of thermal expansion, cooling gas flow, mechanical vibrations, and the like. The crossbar of the T tends to tilt relative to the leg, which may result in shorting of the heater element to other parts of the furnace structure or the load in the furnace. Breakage is also a problem when attempting to remove or replace the heater element supports. In high-temperature furnaces, heater elements, heat-shields and supports for the heater elements are often made of molybdenum. This material becomes quite brittle after heating to elevated temperatures.

It is also important to provide good electrical insulation between the heater element and other portions of the furnace. This electrical insulation must not only isolate the heater element when the furnace is first put into service, but must also maintain such isolation after heating. A problem encountered in high-temperature vacuum furnaces is "metallizing." Components of the furnace and articles being heated in the furnace may evolve metal vapors that deposit on electrical insulators and provide an electrically conductive path which shorts such a heater element to other parts of the furnace. The electrical insulation should resist such shorting when metallizing occurs.

The heater support must also accommodate dimensional changes in the heater and the furnace. Typically, one part of the support is at relatively low temperature, while another part is at relatively high temperature. The heater element itself undergoes thermal expansion as it is heated. The consequent dimensional changes must be accommodated by the support without applying large mechanical loads on the brittle heating element, which could result in breakage.

U.S. Pat. No. 4,771,166 has provided an excellent support for an electric heating element in a vacuum furnace. The heater support has two similar support assemblies spaced apart with a rigid bridge compliantly mounted therebetween. The heater strip is compliantly connected to the bridge. Each of the mounting assemblies has a metal post connected to the heating chamber of the furnace and surrounded by a ceramic sleeve. The ceramic sleeve is surrounded by two ceramic tubes which hold the end of the bridge.

Additional improvements could, however, be made in such a heater support for reducing heat conduction though the metal post that secures the tubes in place in the furnace chamber. This mounting support also has a number of separate pieces which must be separately fabricated and it takes appreciable time to assemble. It is desirable to provide a heater support which does not deform upon heating, supports a heater element compliantly to accommodate thermal expansion, does not penetrate the heater element and lead to localized heating, does not short out to the furnace structure due to metallizing and is made with a minimum number of parts.

SUMMARY OF THE INVENTION

To address such problems, there is provided in practice of this invention according to a presently preferred embodiment, a mechanical support for an electric heating element in a vacuum furnace or the like which comprises a ceramic post having an internal thread in its outer end. A threaded rod secured to a portion of the furnace engages the internal thread of the post for mounting the support. A transverse member at the inner end of the post includes a straight surface normal to the length of the post for engaging a flat heater element. The heater element is secured to the straight surface by, for example, a rod over the heater element which is secured to the transverse member by twisted wires.

Preferably, the post and transverse member are integral and form a T-shaped ceramic support. Alternatively, the post has a transverse slot in its inner end of the post and an L-shaped metal sheet has one leg of the L in the slot and the other leg of the L forming the flat surface. In still another embodiment, a second ceramic post identical to the first post is spaced apart from the first post. A transverse metal member extends between the first and second posts to form the flat surface, forming a U-shaped support for the heater element.

DESCRIPTION OF THE DRAWINGS

These and other features and advantages of the present invention will be apparent from the following detailed description when considered in connection with the accompanying drawings wherein.

DETAILED DESCRIPTION

Figure 1:
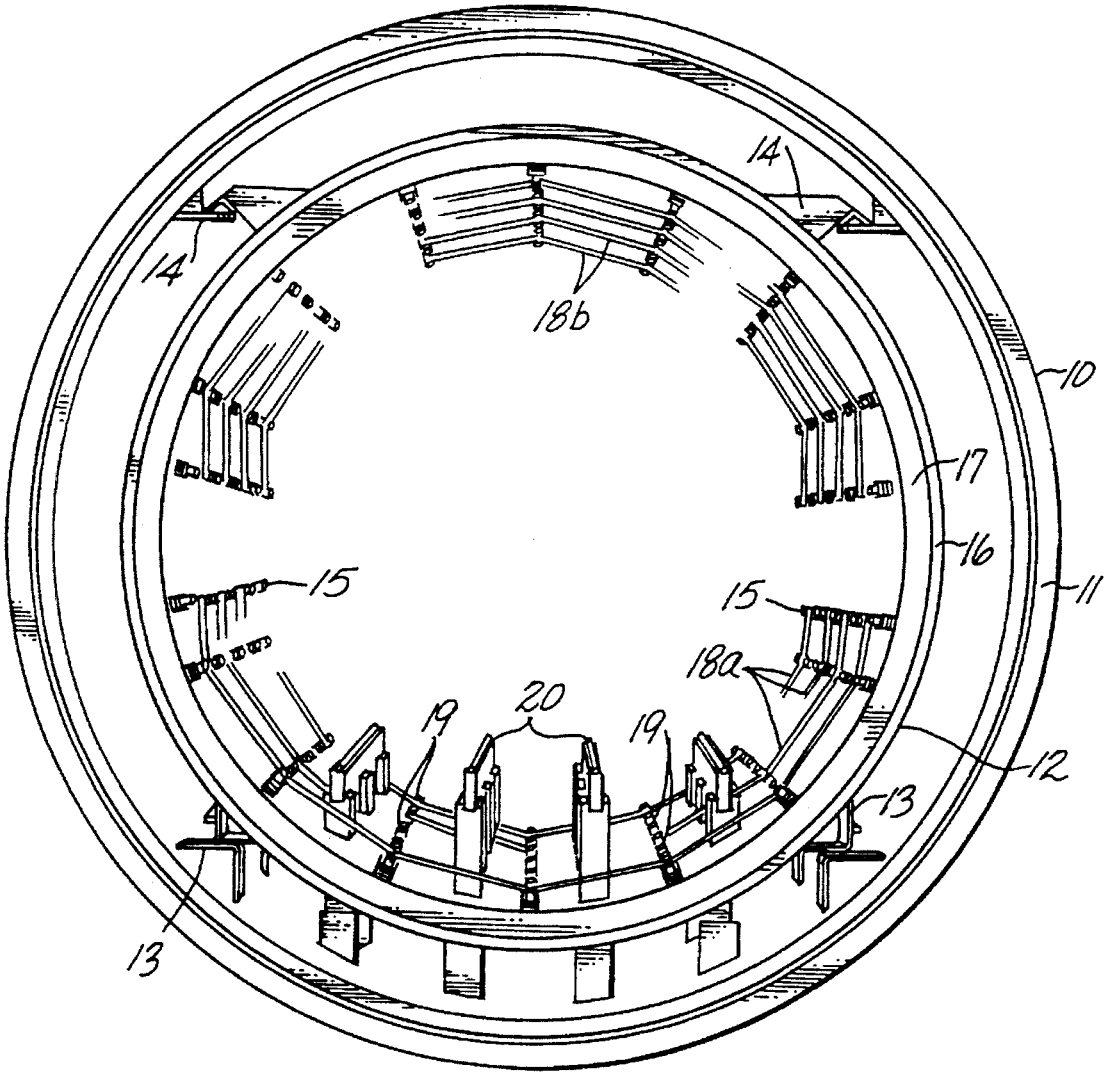
FIG. 1 is an end perspective view into a vacuum furnace.

An exemplary vacuum furnace comprises a horizontal cylindrical shell 10 having a sealing flange 11 at the end, against which a door (not shown) is sealed to close the furnace. The furnace illustrated in FIG. 1 is schematic and does not include a variety of conventional features such as support legs, doors, vacuum pumps, water cooling jackets, gauges, power supplies, etc., which are not required for an understanding of this invention. The drawing simply shows the general location of the heater elements and their supports employed in practice of this invention.

In the exemplary furnace, there is a horizontal cylindrical hot zone 12 suspended away from the furnace shell by upper support brackets 14 a short space above lower brackets 13. Minimal cross-section supports are employed for minimizing heat transfer from the heating chamber to the water-cooled furnace shell. In a typical embodiment, the hot zone comprises a double walled sheet metal plenum 16 into which cooling gas can be circulated for rapid cooling of the hot zone and its contents.

Inwardly from the plenum is a layer (or layers) of thermal insulation 17 which may be in the form of a plurality of parallel metal radiation shields, fibrous ceramic insulating "wool", graphite "wool", or ceramic or graphite insulating sheets. Regardless of the insulation employed in the hot zone, the innermost face is typically formed of sheet metal or flexible graphite sheet (Grafoil) which may be bonded to other materials. Such thermal insulation is conventional and need not be further described for an understanding of this invention.

A plurality of electrical heating elements 18 extend circumferentially around the interior of the hot zone. In the embodiment illustrated, there are a plurality of lower heating elements 18*a*, each of which extends around approximately half of the circumference of the hot zone. Similar upper heating elements 18*b* extend around the upper half of the hot zone. Each heating element has conventional bolted electrical contacts 15 at each end for passing electric current through the heating element. Each heating element is mechanically supported between its ends by a plurality of supporting assemblies illustrated in greater detail in the other drawings.

A plurality of furnace load supporting structures 20 extend from the furnace shell between the heater elements into the hot zone. Baskets of parts (not shown) or other objects to be heated are placed on such supporting structures when the furnace is in use.

To give an order of magnitude, a furnace such as illustrated in FIG. 1 may have a hot zone with a 1.5 meter diameter. Supports for the heating elements are spaced in the order of 30 cm. apart around the hot zone. Typical molybdenum heating elements are from 6 to 15 cm. wide. Four or more such heating elements are spaced along the length of the hot zone, depending on its total length. Such heating elements are generally not a continuous semicircle, but instead are formed as a plurality of straight sections between adjacent support assemblies, with a small straight section adjacent to each support assembly. Small angle bends are sufficient to form such a heating element for an exemplary 1.5 meter diameter furnace. Such bends are readily made on a break and avoid the need for rolls for rolling a continuously curved heating element.

Figure 3:
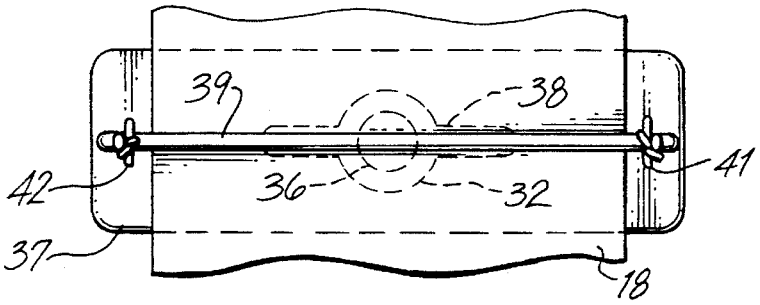
FIG. 3 is a plan view of the T-shaped heater element support.
Figure 2:
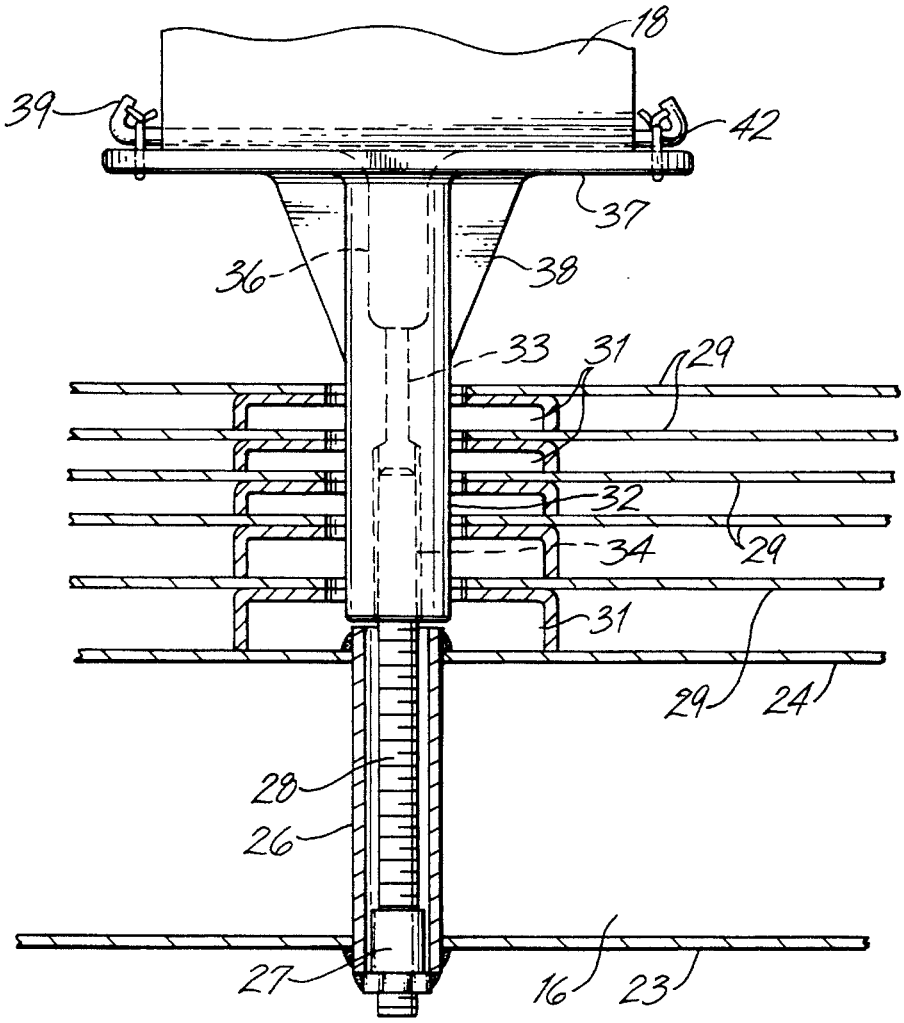
FIG. 2 is a side elevation view of a T-shaped heater element support mounted in the furnace shell.
Figure 4:
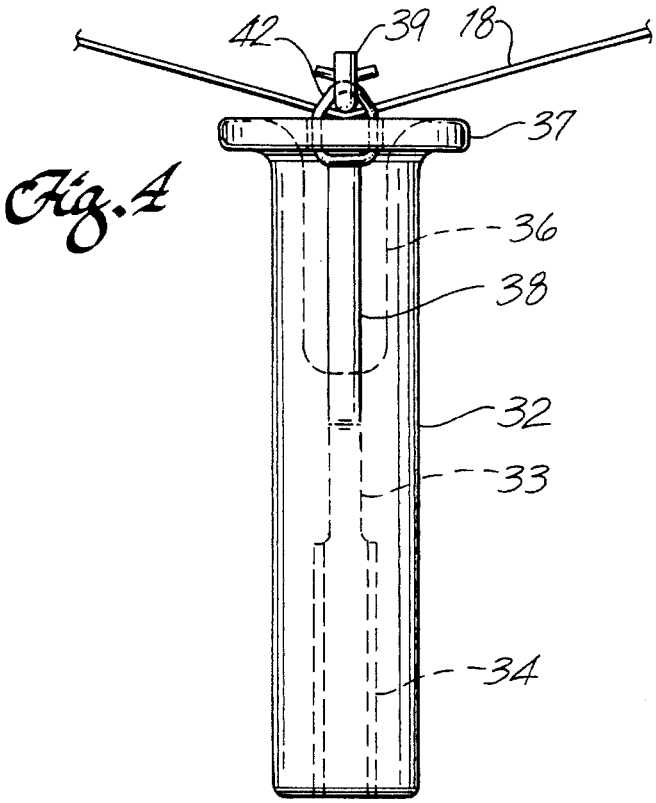
FIG. 4 is an end elevation view of the T-shaped heater element support.

An exemplary T-shaped heater support is illustrated in FIGS. 2 to 4. The side elevation view of FIG. 2 looks at such a support assembly circumferentially around the hot zone, that is, along the length of the heating element 18.

In the description of the heater supports, the portion of the heater support that connects to the heating chamber of the furnace is referred to as the outer portion since it is radially outward in a circular furnace as illustrated herein. Similarly, the opposite end that extends toward the center of the heating chamber is referred to as the inner portion.

The plenum 16 around the heating chamber is formed by an outer sheet metal wall 23 and an inner sheet metal wall 24. Typically, these walls are steel rolled into a cylinder. A steel tube 26 extends through the plenum and is welded to the inner and outer plenum walls at the location of each mounting assembly. Additional spacers between the sheets may be employed, but other details of the plenum are not required for an understanding of this invention.

A stainless steel nut 27 is welded into the outer end of the tube 26. A molybdenum rod 28 with roll formed threads is threaded into the nut and extends inwardly toward the center of the furnace. Molybdenum is used for this and other structural elements which may be exposed to elevated temperatures because of its ability to withstand the temperatures encountered in the vacuum furnace. Depending on the temperature requirements for the furnace, the various metal and ceramic parts may be fabricated of lower cost materials than the molybdenum, stainless steel and alumina mentioned herein.

One type of thermal insulation commonly employed in vacuum furnaces comprises a plurality of sheet metal radiation shields 29. In a vacuum radiation is the principal mechanism of heat transfer. A plurality of reflective radiation shields can be quite effective in providing a temperature gradient between the inner hot zone of the furnace and the surrounding shell. In an exemplary embodiment as illustrated in FIG. 2, five such radiation shields are employed inwardly of the plenum walls, which themselves act as radiation shields. At the location of the mounting assembly, U-shaped sheet metal spacers 31 keep the radiation shields spaced apart from each other. Three or four innermost radiation shields and spacers may be fabricated of molybdenum while the outer ones are safely fabricated of less expensive stainless steel.

The radiation shields and spacers each have a hole for providing ample clearance around a ceramic post 32 of the heater element support to permit shifting of the shields due to thermal expansion without applying loads on the heater support. A high-temperature ceramic such as alumina or alumina-based composition is preferred for the heater support. An exemplary ceramic composition which is commercially available from Coors Ceramics Co. of Golden, Colo., is 97.3% alumina. It is a feature of the ceramic used for the heater support that it can be molded and/or machined to complex shapes, including threads.

Lower alumina ceramics may be used for lower cost, it being recognized that 100 or more heater supports may be used in an exemplary furnace. Cost, however, is not a great concern since the improved heater element supports provide a prolong lifetime for the heater elements in the furnace and the time before it is necessary to rebuild the heater system of the furnace can be significantly prolonged.

The post 32 of the heater support has an axial passage 33 through the full length of the post. The outer end of the passage includes an internal thread 34 so that the ceramic post can be threaded onto the molybdenum rod 28. The passage has a large diameter counterbore 36 near its inner end, thereby reducing the wall thickness of the ceramic for minimizing heat transfer.

A flat transverse member 37 is integral with the post so that the heater support is T-shaped. The transverse member is further connected to the post by integral diagonal wings 38. In this embodiment, the top surface of the T is flat. If desired, the transverse member could have a shallow V-shape in traverse cross-section (viewed as in FIG. 4) as long as there is a straight central line for supporting a heater element.

The heater element 18, which is, for example, a sheet of molybdenum, is bent in a shallow V-shape adjacent the heater support so that the heater element extends straight from support to support around the inside of the furnace. The heating element rests on top of the crossbar of the T-shaped heater support. It is compliantly secured to the crossbar by a molybdenum retaining rod 39 which has a length greater than the width of the heating element. Each end of the retaining rod has an L-shaped bend, and the rod is tied to the bridge by twisted loops of molybdenum wire 42 extending through holes 41 near each end of the crossbar. There are no holes in the heating element. By loosely tying the retaining rod to the crossbar, the heater element is compliantly secured so that it can shift as required by thermal expansion.

If desired, the heating element may not be completely flat but may have stiffening ridges bent into the sheet metal extending along its length. The retaining rod in such an embodiment lies atop the stiffening ridges.

The ceramic post is threaded onto the molybdenum rod about 2.5 cm. When the ceramic post and molybdenum rod are threaded together, the connection is stopped before the outer end of the post engages the inner wall 24 of the plenum or the end of the tube 26 through the plenum. This means that there is a small amount of compliance of the T-shape heating element support relative to the plenum. The support can tilt or rotate slightly as required to accommodate thermal expansion variations that would otherwise apply undue loads on the heating elements.

Figure 7:
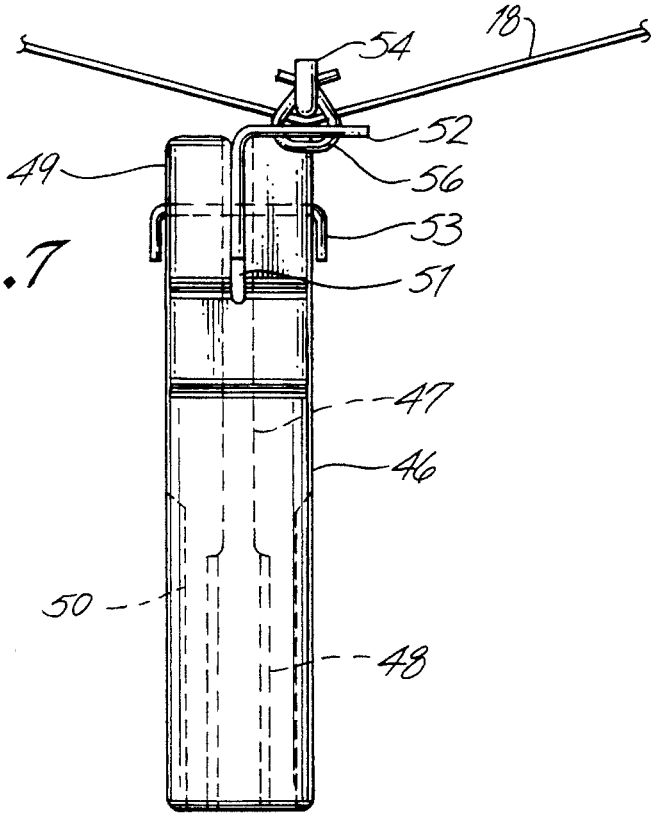
FIG. 7 is a side elevation view of the heater element support of FIG. 5.
Figure 6:
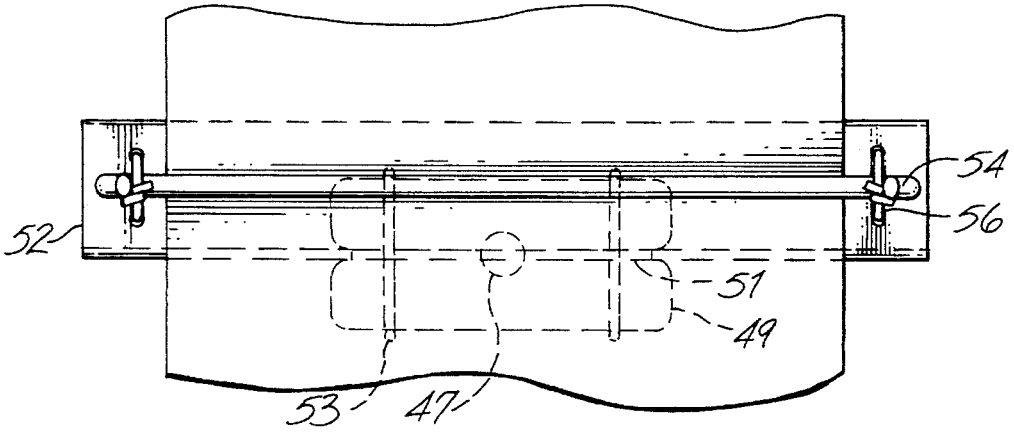
FIG. 6 is a plan view of the heater element support of FIG. 5.
Figure 5:
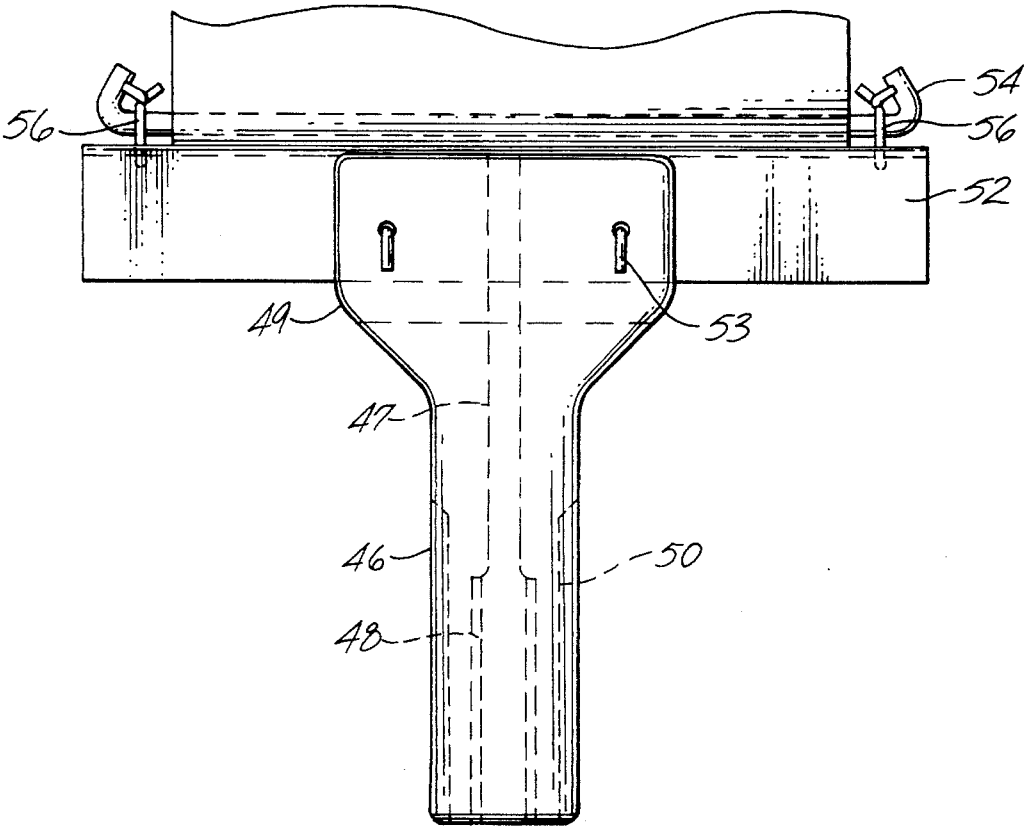
FIG. 5 is a side elevation view of another embodiment of T-shaped heater element support.

FIGS. 5 to 7 illustrate another embodiment of T-shaped heating element support having a ceramic post connected to the cooling gas plenum by a threaded connection. In this embodiment, a round ceramic post has an axial passage 47 through the full length of the post for reducing heat transfer and aiding in forming an internal thread 48 at the outer end of the post. The connection of the post to the furnace by a threaded rod is not illustrated in these drawings since the connection is essentially identical to the connection hereinabove described and illustrated in FIG. 2.

The inner end of the post has an enlarged somewhat T-shaped head 49 which is generally rectangular in transverse cross-section (FIG. 6). A transverse slot 51 extends the full length of the rectangular head. An L-shaped sheet 52 of molybdenum has one leg of the L in the slot. The sheet of molybdenum is loosely held in place by a pair of molybdenum wires 53 passed through aligned holes in the head of the post and sheet respectively. The ends of the wire are bent over to keep them in place. The other leg of the L-shaped sheet of molybdenum forms the flat surface of the crossbar of the T to which the heater element is attached. The heater element 18 is compliantly secured to the molybdenum sheet by a retaining rod 54 compliantly tied to the sheet by retaining wires 56.

Figure 8:
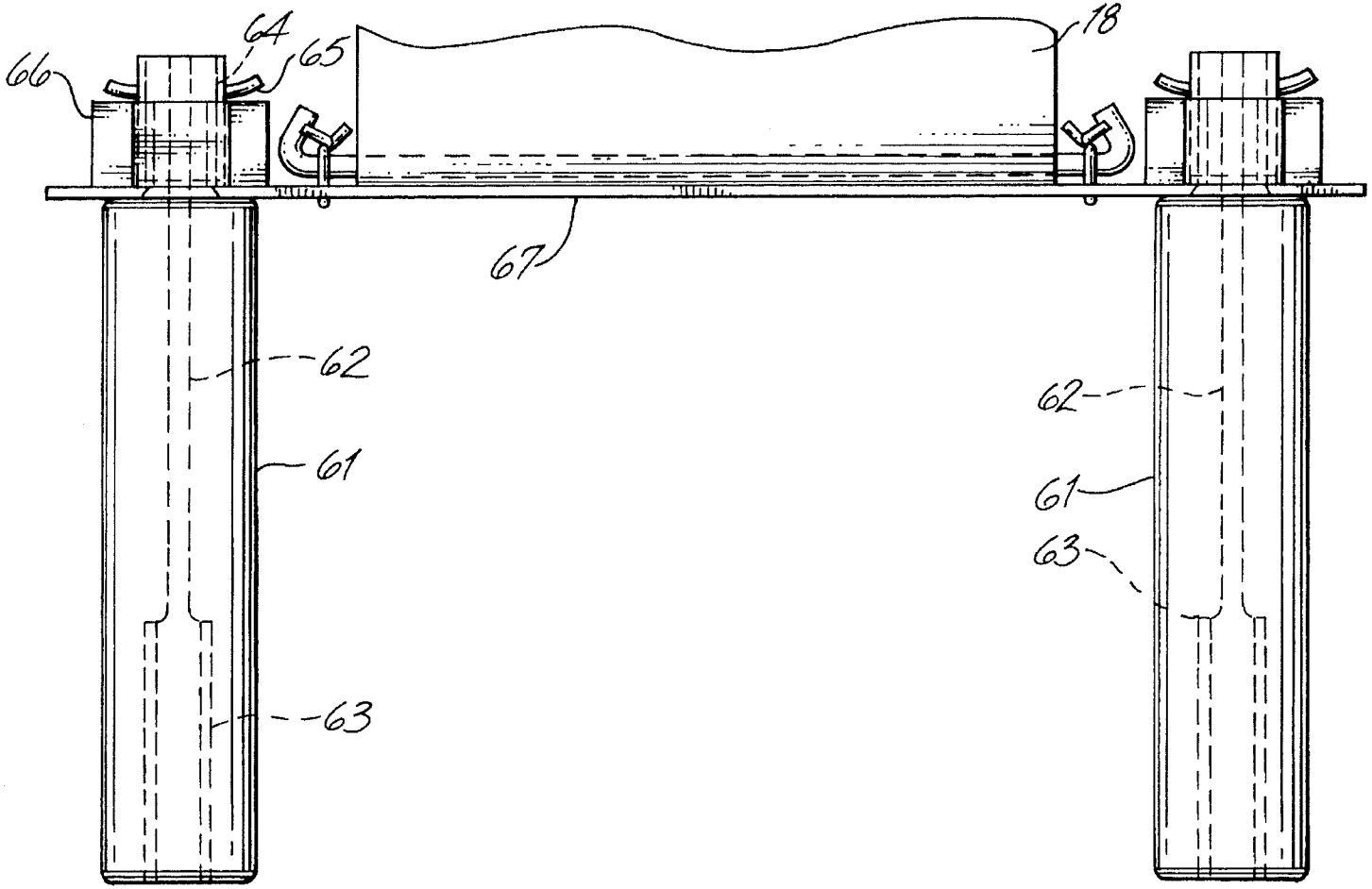
FIG. 8 is a side elevation view of a U-shaped embodiment of heater element support.

Similar principles are employed for constructing a U-shaped heater element support which can be used for retrofitting furnaces originally constructed with heater element supports as described and illustrated in U.S. Pat. No. 4,771,166. In such an embodiment, as illustrated in FIG. 8, there are a pair of substantially identical ceramic posts 61. Each of the posts includes an axial passage 62, the outer end of which includes an internal thread 63. The ceramic posts are each mounted to the gas plenum of the furnace by a threaded rod (not illustrated in FIG. 8) passing through a nut welded to the gas plenum as hereinabove described and also as employed in U.S. Pat. No. 4,771,166.

The inner end of each of the ceramic posts has an external thread 64. A ceramic nut 66 on this external thread holds a sheet molybdenum bridge 67 between the two posts. The heater element 18 is compliantly secured to the bridge by a molybdenum retaining rod 68 tied to the bridge by twisted loops of molybdenum wire 69. The nut is not threaded tightly against the molybdenum bridge so as to accommodate thermal expansion. If desired, a molybdenum key wire 65 passed through a hole transverse to the post may be used for retaining the nut on the external thread of the post.

A ceramic post threaded onto a rod attached to the gas plenum provides good electrical insulation between the heating element and adjacent metallic parts of the furnace. Metallizing of the ceramic during operation of the furnace is not a problem. The outer end of the ceramic rod passes through holes in the radiation shields or other thermal insulation employed in the furnace. The insulation shadows the outer end of the rod and thereby, prevents any appreciable deposition of metal. Furthermore, the outer end of the ceramic post is not in contact with the gas plenum. The only contact with electrically conductive structure is to the threaded rod in the outer end of the post and the face of the post surrounding the rod is amply protected from metallizing.

Although limited embodiments of heater element supporting structure have been described and illustrated herein, many modifications and variations will be apparent to one skilled in the art.

It will be recognized that the exemplary furnace is just one of many possible embodiments. Such a furnace may have a vertical cylindrical shell or be rectangular or have any desired shape or size. It may be a bottom loading or top loading furnace instead of the end loading furnace as illustrated. On a smaller diameter furnace, the electrical heating elements may extend substantially completely around the circumference of the hot zone. On larger furnaces, heating elements may extend less than half way around the hot zone. Continuous strip heating elements may be used which make repeated paths around the furnace or which are connected for three phase power. Such heater supports may also be used for supporting intermediate portions of sinusoidal heating elements which traverse longitudinally through the furnace shell. They may also be used for supporting parts of flat heating elements in rectangular furnaces.

Many other variations and modifications of electric vacuum furnaces or the like in which this invention may be employed will be apparent. The invention is also described in connection with a vacuum furnace, however it will be apparent that it is equally applicable in protective atmosphere furnaces, or in furnaces operated in air when oxidation resistant materials are employed. Molybdenum is not the only material for fabrication of the parts of the heater elements and their supports. Tantalum and tungsten are other exemplary high temperature materials. Analogous supports may be used for graphite or alloy heating elements as well. Although high alumina ceramics are preferred for elevated temperature resistance, other structural ceramics may be used for lower temperature applications.

For such reasons, it is to be understood that within the scope of the appended claims, this invention may be practiced otherwise than as specifically described.

What is claimed is:

1. A mechanical support for an intermediate portion of an electric heater element in a furnace comprising:

a ceramic post having a length and an internal thread in an outer end;

a threaded rod secured to a portion of the furnace and engaging the internal thread of the post;

a transverse member at an inner end of the post including a straight surface normal to the length of the post; and means adjacent to the straight surface for securing a heater element to the straight surface.

2. A support as recited in claim 1 wherein the transverse member is a ceramic member integral with the inner end of the post and forming a T-shaped ceramic support.

3. A support as recited in claim 2 wherein:

the post is generally cylindrical and has an axial passage therethrough, the passage having an inner end and an outer end, the inner end of the passage being enlarged for low heat transfer, the outer end of the passage comprising the internal thread; and the transverse member comprises a flat inner surface, a flat outer surface, and diagonal reinforcing wings connecting the flat outer surface and the post.

4. A support as recited in claim 3 wherein the transverse member also includes a pair of spaced apart holes adjacent each end of the member for receiving a tie wire.

5. A support as recited in claim 1 wherein the post comprises a hollow portion in at least the inner end of the post.

6. A support as recited in claim 1 wherein the transverse member comprises is a metal member secured to the post and forming a T-shaped support.

7. A support as recited in claim 6 wherein the post comprises a transverse slot in the inner end of the post and the metal member comprises an L-shaped sheet having a first leg of the L-shaped sheet in the slot and a second leg of the L-shaped sheet forming the straight surface.

8. A support as recited in claim 7 further comprising a pair of holes through the post transverse to the slot and a pair of holes through the first leg, each hole in the first leg being aligned with a hole through the post, and a wire extending through each set of holes in the first leg and post, respectively, for securing the L-shaped sheet in the slot.

9. A support as recited in claim 1 further comprising an axial passage extending through the post, the thread being in the outer end of the passage.

10. A support as recited in claim 1 wherein the post comprises an enlarged inner end, a transverse slot in the enlarged inner end, a pair of holes extending through the enlarged inner end transverse to the slot, and an axial passage extending through the post, the passage having an inner end and an outer end, the thread being in the outer end of the passage.

11. A support as recited in claim 1 further comprising a second ceramic post identical to the first mentioned post and spaced apart therefrom, and wherein the transverse member comprises a member extending between the first and second posts and forming a U-shaped support.

12. A support as recited in claim 11 wherein the transverse member is a metal sheet.

13. A support as recited in claim 11 wherein each post comprises an external thread at the inner end of each post and further comprising a ceramic nut on each external thread clamping the transverse member to the post.

14. A support as recited in claim 11 further comprising an axial passage extending through the post, the passage having an inner end and an outer end, the internal thread being in the outer end of the passage.

15. A support as recited in claim 1 wherein the post comprises an external thread at the inner end of the post and further comprising a ceramic nut on the external thread.

16. A mechanical support for an intermediate portion of an electric heater element in a furnace comprising:

a T-shaped ceramic post having a leg, an internal thread in the leg of the post and a ceramic crossbar having a straight surface normal to the length of the leg for receiving a heater element.

17. A support as recited in claim 16 wherein the T-shaped ceramic post has an inner end and comprises a hollow portion in at least the inner end of the post.

18. A support as recited in claim 16 wherein:

the leg is generally cylindrical and has an axial passage therethrough, the passage having an inner end and an outer end, the inner end of the passage being enlarged for low heat transfer, the outer end of the passage comprising the internal thread.

19. A support as recited in claim 16 wherein the crossbar comprises a straight inner surface, an outer surface, and diagonal reinforcing wings connecting the outer surface and the post.

20. A mechanical support for an intermediate portion of an electric heater element in a furnace comprising:

a ceramic post having a length and an internal thread; and a metallic crossbar connected to the post and having a straight surface normal to the length of the post for receiving a heater element.

21. A support as recited in claim 16 wherein the post has an inner end and comprises a transverse slot in the inner end and further comprising a L-shaped metal member having one leg of the L-shaped member in the slot and the other leg of the L-shaped member forming the straight surface.

22. A support as recited in claim 21 further comprising a pair of holes through the post transverse to the slot and a pair of holes through the leg of the L-shaped member in the slot, each hole in the leg being aligned with a hole through the post, and a wire extending through each set of holes in the leg and post, respectively, for securing the leg of the L-shaped member in the slot.

23. A support as recited in claim 20 further comprising an axial passage extending through the post, the passage having an outer end, and the thread being in the outer end of the passage.

24. A support as recited in claim 20 wherein the post comprises an enlarged inner end, a transverse slot in the enlarged inner end, a pair of holes extending through the enlarged inner end transverse to the slot, and an axial passage extending through the post, the thread being in the outer end of the passage.

25. A vacuum furnace comprising:

a furnace shell;

a heating chamber in the furnace shell;

at least one metal strip heater element in the heating chamber of the furnace;

means for making electrical contact with each end of the heater element for passing electric current therethrough; and at least one mechanical support for an intermediate portion of the electric heater element comprising:

a T-shaped ceramic support for an intermediate portion of the heater element having the leg of the T-shaped ceramic support connected to the heating chamber; and means for compliantly securing the heater element to the crossbar of the T-shaped ceramic support without holes in the heater element.

26. A vacuum furnace as recited in claim 25 wherein an outer end of the ceramic support is spaced apart from the heating chamber.

27. A vacuum furnace as recited in claim 25 wherein an outer end of the T-shaped ceramic support is threaded and comprising a threaded connection between the T-shaped ceramic support and the heating chamber.

28. A vacuum furnace as recited in claim 27 wherein an outer end of the T-shaped ceramic support comprises an internal thread and further comprising an external thread connected to the heating chamber, the external thread and internal thread being the only connection between the leg of the T-shaped ceramic support and the heating chamber.

29. A vacuum furnace as recited in claim 25 wherein the T-shaped support comprises a ceramic post having an outer end connected to the heating chamber and a metal member connected to an inner end of the post forming a portion of the crossbar of the T-shaped support.

30. A support as recited in claim 29 wherein the ceramic post comprises a transverse slot in the inner end of the post and the metal member comprises an L-shaped sheet having a first leg of the L-shaped sheet in the slot and a second leg of the L-shaped sheet forming a straight surface.

31. A vacuum furnace comprising:

a furnace shell;

a heating chamber in the furnace shell;

at least one metal strip heater element in the heating chamber of the furnace;

means for making electrical contact with each end of the heater element for passing electric current therethrough; and at least one mechanical support for an intermediate portion of the electric heater element comprising:

a ceramic post having a length and an outer end connected to the heating chamber by a thread on the ceramic;

a metal crossbar on an inner end of the ceramic post for supporting an intermediate portion of the heater element; and means for compliantly securing the heater element to the metal crossbar without holes in the heater element.

32. A vacuum furnace as recited in claim 31 wherein the thread on the ceramic post is an internal thread and the post is connected to the heating chamber solely by a threaded rod.

33. A vacuum furnace as recited in claim 31 wherein the ceramic post comprises a slot in the inner end of the post transverse to the length of the post and the metal crossbar comprises an L-shaped sheet metal piece, one leg of the L-shaped piece being in the slot and the other leg of the L-shaped piece supporting the heater element.

34. A vacuum furnace comprising:

a furnace shell;

a heating chamber in the furnace shell;

at least one metal strip heater element in the heating chamber of the furnace;

means for making electrical contact with each end of the heater element for passing electric current therethrough; and at least one mechanical support for an intermediate portion of the electric heater element comprising:

a first ceramic post having an outer end connected to the heating chamber by a thread on the ceramic;

a second ceramic post identical to the first mentioned post and spaced apart therefrom;

a metal bridge between the first and second ceramic posts forming a U-shaped support; and means for compliantly securing the heater element to the metal bridge without holes in the heater element.

35. A support as recited in claim 34 further comprising an axial passage extending through each post, the passage having an inner end and an outer end, the thread being an internal thread in the outer end of the passage.

36. A support as recited in claim 35 wherein each post comprises an external thread at the inner end of the post and further comprising a ceramic nut on the external thread.

* * * * *